US005706526A

United States Patent [19]

Huang

[11] Patent Number: 5,706,526

[45] Date of Patent: Jan. 13, 1998

[54] SWIMMING GOGGLES

[76] Inventor: Ann Huang, No. 398, Chian Ping 8th Street, An Ping District, Tainan City, Taiwan

[21] Appl. No.: 732,809

[22] Filed: Oct. 15, 1996

[51] Int. Cl.[6] ..... A61F 9/02

[52] U.S. Cl. ..... 2/428; 2/452; 351/43

[58] Field of Search ..... 2/428, 429, 430, 2/452; 351/43, 156

[56] References Cited

U.S. PATENT DOCUMENTS

| | | | |
|---|---|---|---|
| 3,038,375 | 6/1962 | Gansz | 351/43 |
| 4,051,557 | 10/1977 | Bengtson et al. | 2/430 |
| 4,966,451 | 10/1990 | Corral et al. | 351/43 |
| 5,303,428 | 4/1994 | Pernicka | 2/428 |
| 5,390,373 | 2/1995 | Flory | 2/430 |
| 5,408,702 | 4/1995 | Chiang | 2/428 |
| 5,596,771 | 1/1997 | Hsu et al. | 2/452 X |
| 5,603,125 | 2/1997 | Chou | 2/428 |

*Primary Examiner*—Peter Nerbun
*Attorney, Agent, or Firm*—Morton J. Rosenberg; David I. Klein; Jun Y. Lee

[57] ABSTRACT

A pair of swimming goggles includes a main frame body with two slots respectively defined in two sides thereof, two elastic straps, and two buckles. Each elastic strap includes a first end, a second end, and a mediate section, each elastic strap being wound through the associated slot. The first end of one of the straps has one of the buckles attached thereto, while the second end of the other strap has the other buckle attached thereto, thereby allowing adjustment of the lengths of the straps in response to a shape of a head of the user.

9 Claims, 6 Drawing Sheets

SWIMMING GOGGLES

BACKGROUND OF THE INVENTION

1. Field of the Invention

The present invention relates to a pair of swimming goggles which provides increased comfort during wearing and includes two buoyant blocks such that the swimming goggles may float on the water surface.

2. Description of the Related Art

Swimming goggles may protect the swimmers' eyes and provide an increased view. FIG. 6 of the drawings illustrates a pair of conventional swimming goggles which includes two rigid lenses 61 connected by a connecting member 63 extending through two slotted members 611 respectively attached to two mutually-faced sides of the rigid lenses 61, two frames 62 of plastic material for respectively receiving an associated rigid lens 61 therein, and a strap 64. Each lens 61 further includes a second slotted member 612 provided to the other side thereof. The strap 64 includes a split mediate section which consists of an upper strap section 642 and a lower strap section 643. Each of two ends 641 of the strap 64, before extending through a buckle 65, is extended through the associated second slotted member 612, thereby allowing adjustment of the length thereof. Each frame 62 includes a protective housing 621 integrally formed in an inner side thereof for providing a tight contact with the eye sockets of the users. However, the upper strap section 642 may be too tight while the lower strap section 643 may be too loose at the same time as being unable to fit the shape of the head of the user, and thus results in discomfort.

FIG. 7 illustrates another pair of conventional swimming goggles which includes a strap 71 with a length twice of that of the above-mentioned design. The strap 71 extends through two slots 72 respectively defined in two opposite sides of the lenses, thereby defining an upper strap section 711 and a lower strap section 712 in which one of the strap sections, e.g., the upper strap section 711 has no buckle mounted thereto, while the lower strap section 712 has a buckle 73 mounted to an end thereof for adjustably embracing the head of the user. When in use, it often takes a considerable time for the user to adjust the length of the strap 71 (i.e., the length of the upper strap section 711 without buckle thereon) and to adjust the tightness of the upper and lower strap sections 711 and 712. In addition, the strap 71 diverges into two strap sections after it is extended through the slot 72 which may press against the ears of the users and thus result in discomfort.

Conventional swimming goggles may be lost when swimming, especially when taken off. Accordingly, the user has to buy a new pair.

Therefore, there has been a long and unfulfilled need for a pair of improved swimming goggles which mitigates and/or obviates the above-mentioned drawbacks.

SUMMARY OF THE INVENTION

A pair of swimming goggles in accordance with the present invention comprises a main frame body with two slots respectively defined in two sides thereof, two elastic straps, and two buckles. Each elastic strap includes a first end, a second end, and a mediate section, each elastic strap being wound through the associated slot. The first end of one of the straps has one of the buckles attached thereto, while the second end of the other strap has the other buckle attached thereto, thereby allowing adjustment of the lengths of the straps in response to a shape of a head of the user.

In a preferred embodiment of the present invention, two hollow clamping blocks are provided and each of which includes a bore through which the mediate section of the associated strap is extended twice and thus tightly clamped therein. Preferably, the clamping block is made of buoyant material such that the swimming goggles may float on the water surface when lost in the water.

In an alternative embodiment of the present invention, the buckles are respectively integrally formed to the first end of one strap and the second end of the other strap.

Other objects, advantages, and novel features of the invention will become more apparent from the following detailed description when taken in conjunction with the accompanying drawings.

DESCRIPTION OF THE PREFERRED EMBODIMENTS

Figure 1:
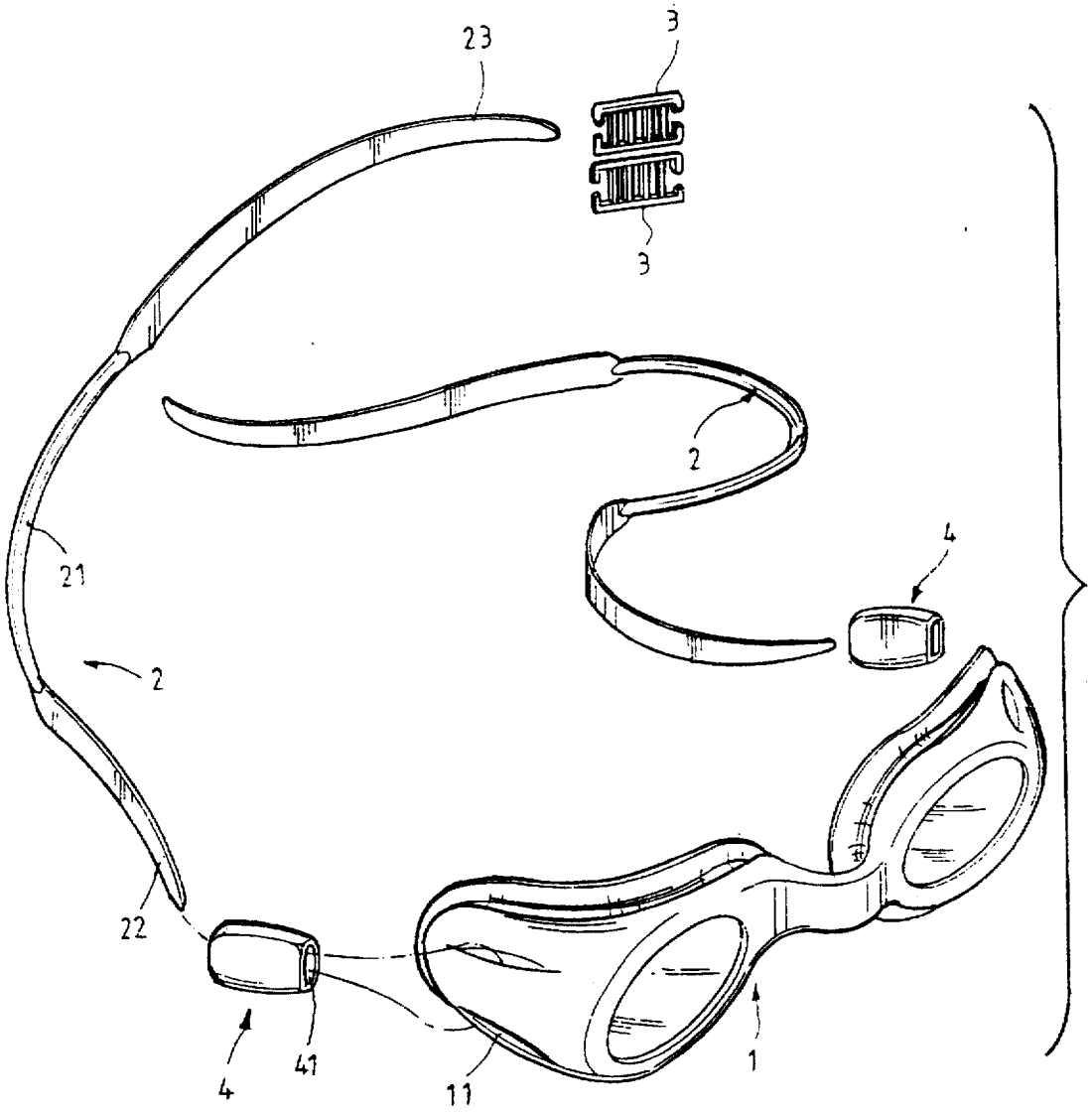
FIG. 1 is an exploded perspective view of a pair of swimming goggles in accordance with the present invention.
Figure 2:
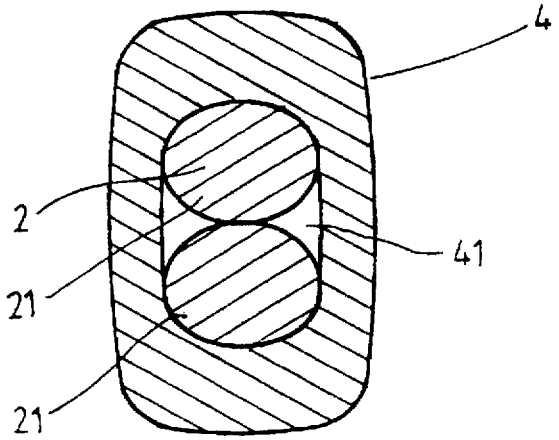
FIG. 2 is a cross sectional view of a clamping block of the swimming goggles in accordance with the present invention.

Referring to FIGS. 1 to 5 of the drawings and initially to FIGS. 1 and 2, a pair of swimming goggles in accordance with the present invention generally includes a main frame body 1 with two slots 11 respectively defined in two sides thereof, two straps 2, two clamping blocks 4, and two buckles 3. Each strap 2 includes a first end 22, a second end 23, and a mediate section 21. Each strap 2 of elastic material is extended through the associated block 4, wound through the associated slot 11, and then again through the associated clamping block 4 such that the mediate section 21 is tightly clamped in the clamping block 4, as shown in FIG. 2. The first end 22 of one strap 2 may have one of the buckles 3 attached thereto, while the second end 23 of the other strap 2 may have the other buckle 3 attached thereto, thereby allowing adjustment of the lengths of the straps 2 in response to the shape of the head of the user.

As shown in FIG. 2, each clamping block 4 is hollow and includes a bore 41 through which the mediate section 21 of the associated strap 2 may be extended twice and thus tightly clamped therein. Thus, the ears of the user need not be pressed by the straps 2, thereby providing an increased comfort. In addition, the clamping block 4 may be made of buoyant material, such that the swimming goggles may float on the water surface when lost in the water.

Figure 3:
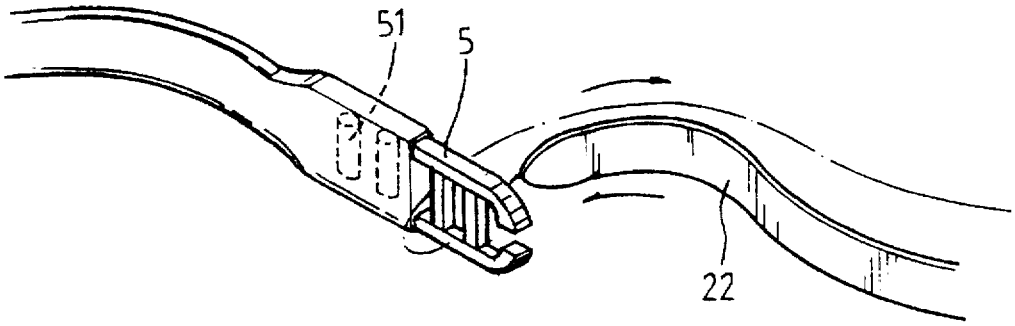
FIG. 3 is a partial perspective view illustrating a second embodiment of a strap of the swimming goggles of the present invention.
Figure 4:
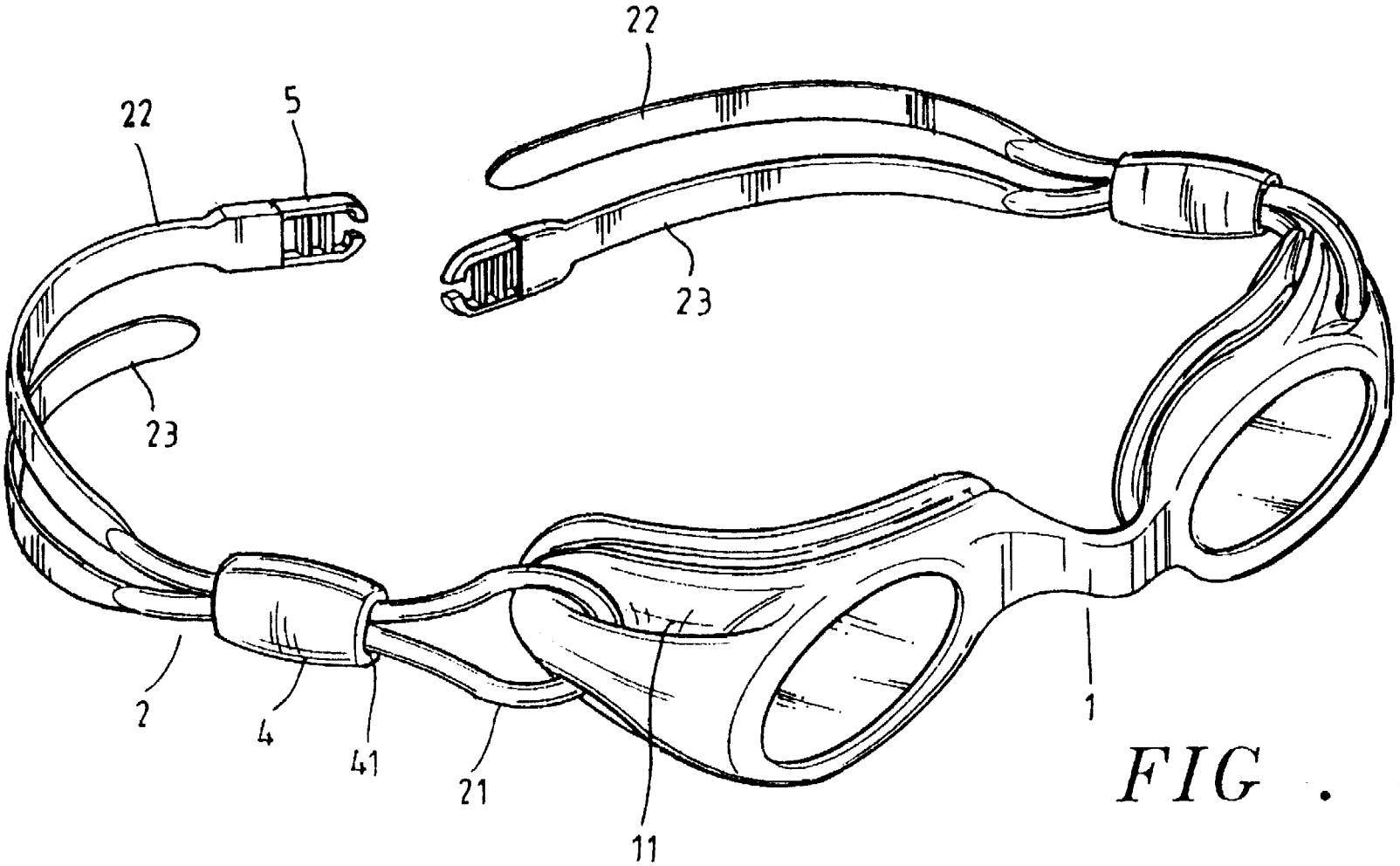
FIG. 4 is a perspective view illustrating the second embodiment of the swimming goggles of the present invention.

FIGS. 3 and 4 illustrate a second embodiment of the present invention, wherein the buckle 3 is replaced by a buckle 5 which is directly integrally formed on an end of the strap 2. As shown in FIG. 3, the buckle 5 may function as a mold per se, such that the end 22, 23 of the strap 2 may be placed into two holes 51 defined in the buckle 5, and plastic material is then ejected into the holes 51 of the buckle 5 for formation, thereby securely joining the buckle 5 to the end of the associated strap 2. When in use, the user may adjust the other end 23, 22 of the strap 2.

Figure 5:
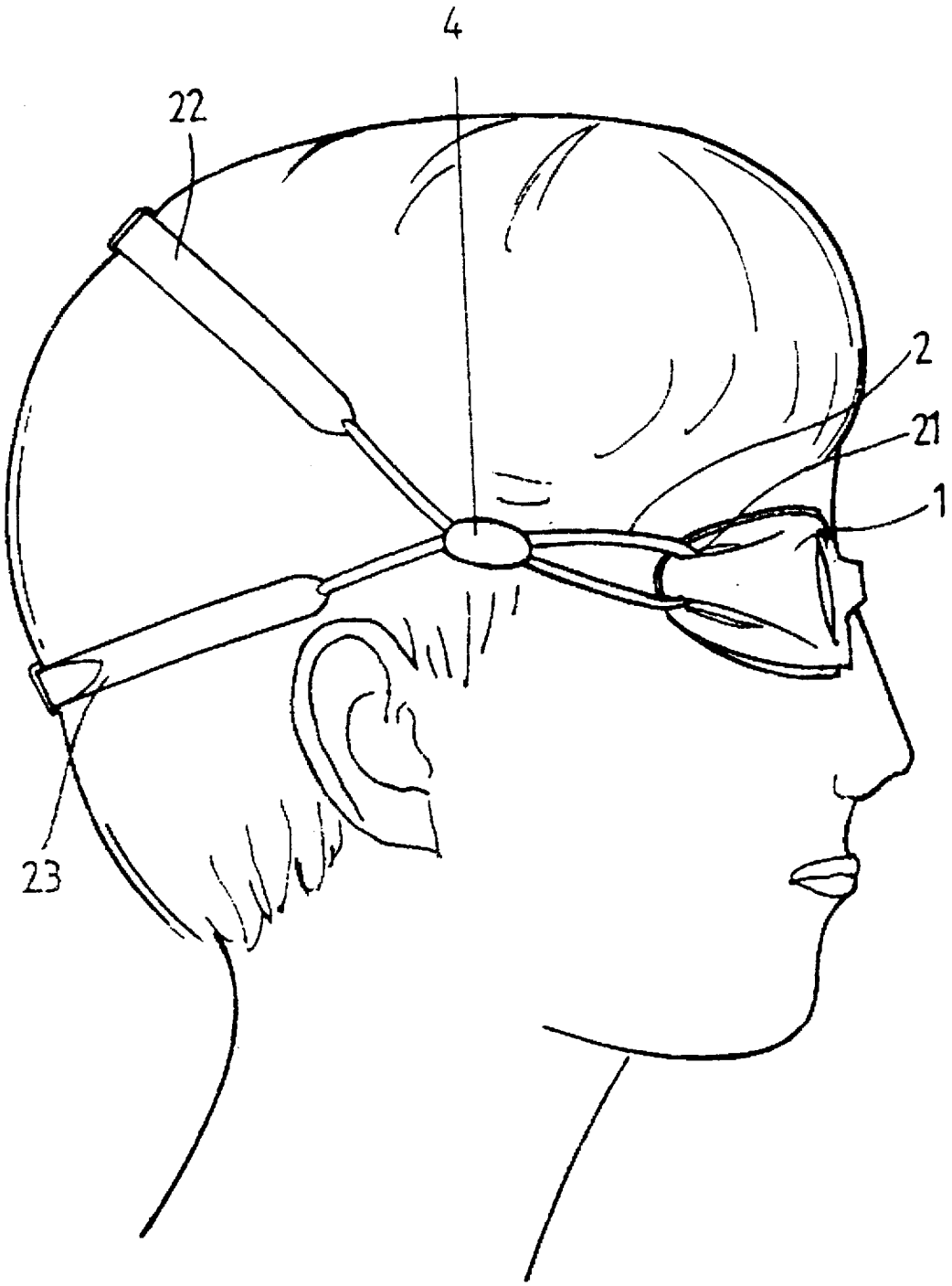
FIG. 5 is a schematic view illustrating the use of the swimming goggles of the present invention.
Figure 6:
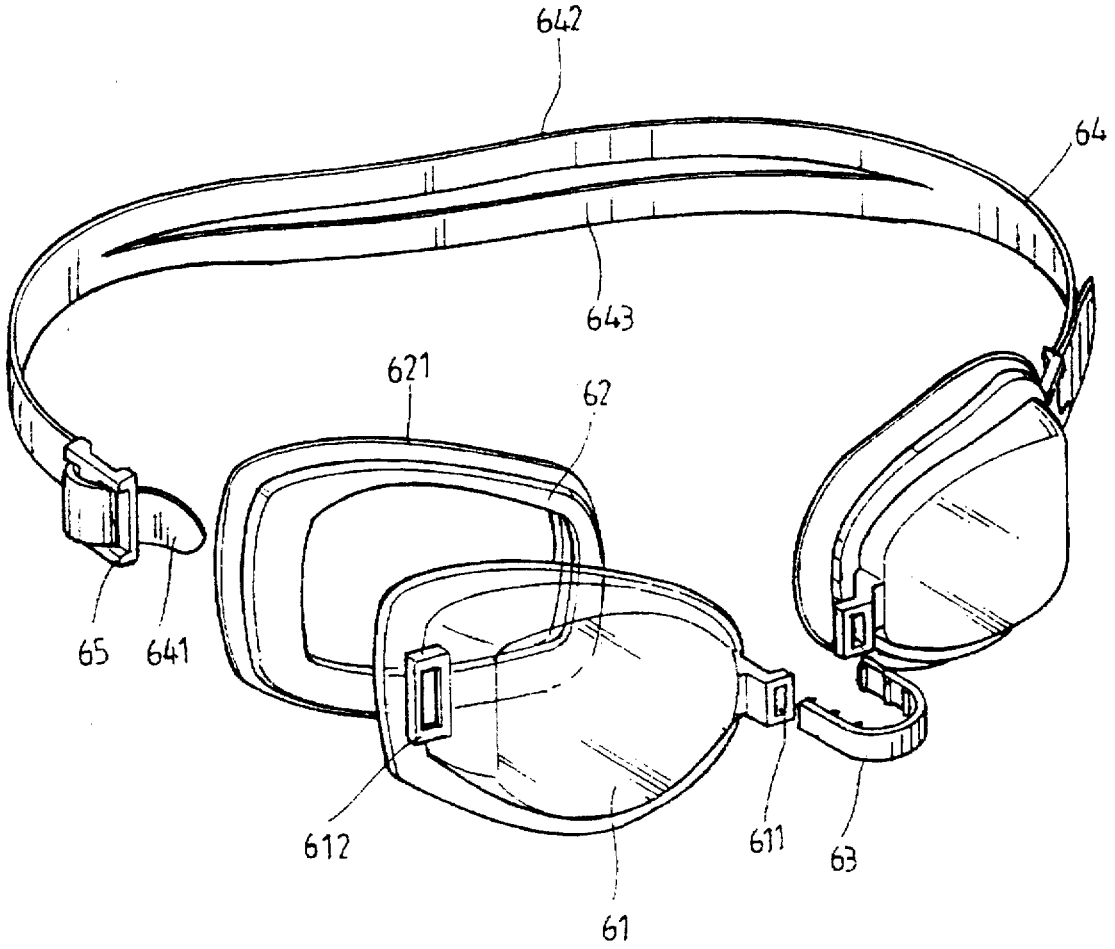
PRIOR ART FIG . 6
FIG. 6 is a perspective view, partly exploded, of a pair of conventional swimming goggles.
Figure 7:
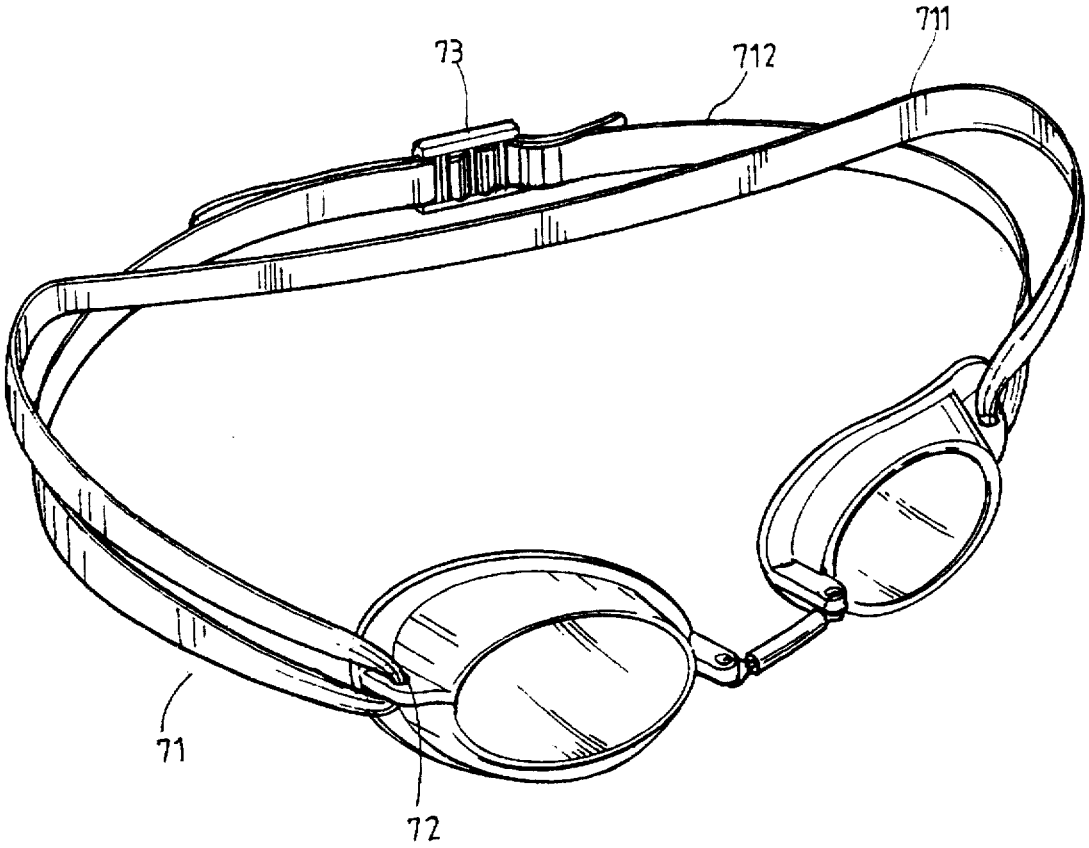
PRIOR ART FIG . 7
FIG. 7 is a perspective view of another pair of conventional swimming goggles.

When in use, as shown in FIG. 5, the lengths of the straps 2 are firstly adjusted in response to the shape of the head of the user by engaging the ends 22, 23 thereof with the buckles 3 or 5, such that the swimming goggles can be attached to the eye sockets closely. In addition, the clamping blocks 4 are mounted to "front ends" of the straps 2 (see reference numeral "21" in FIG. 4) such that the "front ends" of the straps 2 converges, thereby avoiding the ears of the user to be pressed against.

Thus, the swimming goggles of the present invention has the following advantages:

(1) the lengths of the straps 3 can be easily adjusted in response to the shape of the user's head, thereby providing an increased comfort;

(2) the clamping blocks prevent the ears of the user from being pressed by the straps;

(3) the clamping blocks are buoyant such that the swimming goggles may float on the water surface and thus be easily observed when lost in the water; and (4) the buckles 3 can be integrally formed on an end of the strap 2, which is very convenient in use.

Although the invention has been explained in relation to its preferred embodiment, it is to be understood that many other possible modifications and variations can be made without departing from the spirit and scope of the invention as hereinafter claimed.

What is claimed is:

1. A pair of swimming goggles, comprising:

a main frame body having two sides thereof with a slot defined at each of said two sides:

two elastic straps, each strap including first and second band-shaped ends and a mediate section integrally connecting said first and second band-shaped ends and having substantially circular cross-section:

said mediate section being wound through an associated slot at a respective side of the goggles, thereby forming two portions of said mediate section diverging from the associated slot:

two buckles respectively adjusting a length of the elastic straps, with one of said two buckles attached to the first end of one of said two elastic straps and with another of said two buckles attached to the second end of another of said two elastic straps: and, two hollow tubular clamping blocks, each of said clamping blocks including a bore extending longitudinally therethough, said two portions of the mediate section of an associated strap extending through said bore and converging in a respective clamping block, thereby preventing the straps from applying pressure towards a wearer's ears.

2. The swimming goggles according to claim 1, wherein each said clamping block is made of buoyant material.

3. The swimming goggles according to claim 1, wherein said buckles are respectively integrally formed to the first end of said one strap and the second end of the other said strap.

4. The pair of swimming goggles as recited in claim 1 where said two portions of said mediate section of each said elastic strap exits from the associated slot in spaced relationship from the wearer's head.

5. A pair of swimming goggles, comprising.

a main frame body having two sides thereof with a slot defined at each of said two sides;

two elastic straps, each strap including first and second ends and a mediate section integrally connecting said first and second ends, said mediate section being wound through an associated slot at a respective side of the goggles, thereby forming two portions of said mediate section diverging from the associated slot; and, two hollow tubular clamping blocks, each of said clamping blocks having a bore extending longitudinally therethrough, said two portions of said mediate section of each of said straps extending through said bore of a respective one of said clamping blocks and converging therein to prevent said straps from applying pressure towards a wearer's ears.

6. The pair of swimming goggles as recited in claim 5 further comprising two buckles for respectively adjusting a length of said two elastic straps, a first of said two buckles being coupled to said first end of each of said two elastic straps and a second of said two buckles being coupled to said second end of each of said two elastic straps.

7. The pair of swimming goggles as recited in claim 6 where said first buckle is fixed to said first end of one of said elastic straps and adapted to adjustably secure said first end of the other of said elastic straps thereto, said second buckle being fixed to said second end of one of said elastic straps and adapted to adjustably secure said second end of the other of said elastic straps thereto.

8. The pair of swimming goggles as recited in claim 6 where said first buckle is integrally formed on said first end of one of said elastic straps and adapted to adjustably secure said first end of the other of said elastic straps thereto, said second buckle being integrally formed on said second end of one of said elastic straps and adapted to adjustably secure said second end of the other of said elastic straps thereto.

9. The pair of swimming goggles as recited in claim 5 where said two portions of said mediate section of each said elastic strap exit from the associated slot in spaced relationship from the wearer's head.

* * * * *